US005504394A

United States Patent [19]

Johnson

[11] Patent Number: 5,504,394

[45] Date of Patent: Apr. 2, 1996

[54] LAMP BULB HAVING INTEGRATED LIGHTING FUNCTION CONTROL CIRCUITRY AND METHOD OF MANUFACTURE

[75] Inventor: Samuel A. Johnson, Eagle, Id.

[73] Assignee: Beacon Light Products, Inc., Meridian, Id.

[21] Appl. No.: 27,855

[22] Filed: Mar. 8, 1993

[51] Int. Cl.[6] ..... H05B 37/02; H05B 39/02

[52] U.S. Cl. ..... 315/71; 315/307; 315/194; 315/70; 307/157; 323/908; 323/238

[58] Field of Search ..... 315/73, 72, 71, 315/58, 62, 307, 194; 439/620, 611, 612; 323/908, 238; 307/157

[56] References Cited

U.S. PATENT DOCUMENTS

| | | | |
|---|---|---|---|
| Re. 31,848 | 3/1985 | Nilssen | 315/360 |
| 1,297,879 | 3/1919 | Lorenz | 315/71 |
| 3,684,919 | 8/1972 | Cramer | 315/194 |
| 3,697,821 | 10/1972 | Johnson | 307/112 X |
| 3,763,396 | 10/1973 | Shilling | 315/307 |
| 3,808,456 | 4/1974 | Kay et al. | 307/140 |
| 3,818,263 | 6/1974 | Belko | 315/32 |
| 3,823,339 | 7/1974 | Borneman | 315/69 |
| 3,836,814 | 9/1974 | Rodriquez | 315/51 |
| 3,939,361 | 2/1976 | Aidala | 307/141 |
| 3,952,242 | 4/1976 | Ukai | 323/21 |
| 3,975,658 | 8/1976 | Emtage et al. | 315/71 |
| 4,011,482 | 3/1977 | Seib | 315/361 |
| 4,087,723 | 5/1978 | Chermin et al. | 315/207 |
| 4,090,107 | 5/1978 | Seib | 315/156 |
| 4,099,099 | 7/1978 | Grüdelbach | 315/194 |
| 4,118,654 | 10/1978 | Ohta | 40/361 |
| 4,155,015 | 5/1979 | Nakasone | 307/252 B |
| 4,165,475 | 8/1979 | Pegg et al. | 315/99 |
| 4,181,872 | 1/1980 | Chermin | 315/106 |
| 4,204,149 | 5/1980 | Cleary et al. | 323/24 |
| 4,259,619 | 3/1981 | Wall | 315/361 |
| 4,276,486 | 6/1981 | Ahuja | 307/252 B |
| 4,276,542 | 6/1981 | Russ | 340/326 |
| 4,332,632 | 3/1982 | Hart et al. | 307/41 |
| 4,379,237 | 4/1983 | Mosteller, Jr. | 315/194 X |
| 4,496,878 | 1/1985 | Nillssen | 315/73 |
| 4,504,778 | 3/1985 | Evans | 323/323 |
| 4,527,099 | 7/1985 | Capewell et al. | 315/291 |
| 4,591,765 | 5/1986 | Beck | 315/361 |
| 4,613,790 | 9/1986 | Roorda | 315/72 |
| 4,628,230 | 12/1986 | Krokaugger | 315/307 |
| 4,634,957 | 1/1987 | Hollaway | 323/242 |
| 4,644,226 | 2/1987 | Vernooij | 315/50 |
| 4,668,877 | 5/1987 | Kunen | 307/116 |
| 4,695,739 | 9/1987 | Pierce | 307/141 |
| 4,804,916 | 2/1989 | Frank | 323/300 |
| 4,928,055 | 5/1990 | Kaieda | 323/300 |
| 4,988,921 | 1/1991 | Ratner | 315/159 |
| 4,998,044 | 3/1991 | Nilssen | 315/200 C |
| 5,004,957 | 4/1991 | Cunningham | 315/199 |
| 5,030,890 | 7/1991 | Johnson | 315/208 |
| 5,126,634 | 6/1992 | Johnson | 315/71 |
| 5,214,354 | 5/1993 | Johnson | 315/71 |
| 5,264,761 | 11/1993 | Johnson | 315/291 |

FOREIGN PATENT DOCUMENTS

| | | | |
|---|---|---|---|
| 2410884 | 9/1974 | Germany | 315/71 |

*Primary Examiner*—Robert J. Pascal
*Assistant Examiner*—Arnold Kinkead
*Attorney, Agent, or Firm*—John R. Ley

[57] ABSTRACT

An incandescent lamp bulb which is driven by an electronic control module (ECM) and method of manufacture characterized in that an inductor comprising a magnetic spool and a winding thereon is disposed within a screw shell base of the lamp bulb and surrounds the lamp exhaust tube therein. One end of the winding on the magnetic spool is connected to a filament wire within the screw shell base and the other end of the inductive winding is connected to an output terminal of the ECM control module. In this manner, the inductor significantly reduces the di/dt rise time of voltage and current when a TRIAC within the ECM module is driven to conduction on each one half cycle of the applied AC line voltage. This operation in turn produces a substantial reduction in radio frequency interference, both of radiation transmitted into space from the lamp bulb and by direct DC coupling back into the AC line voltage source. In a preferred embodiment, the TRIAC in the ECM is microprocessor-controlled in accordance with the above identified patented inventions.

29 Claims, 4 Drawing Sheets

LAMP BULB HAVING INTEGRATED LIGHTING FUNCTION CONTROL CIRCUITRY AND METHOD OF MANUFACTURE

TECHNICAL FIELD

This invention relates generally to the integration of lighting function control into the manufacture of incandescent lamp bulbs. More particularly, the present invention is directed to the novel construction of an electronic control module (ECM) and associated circuitry into the screw shell base of the lamp bulb in such a manner as to significantly reduce the amount of radio frequency interference (RFI) radiated from the ECM.

BACKGROUND ART AND RELATED INVENTIONS

In U.S. Pat. No. 5,030,890 entitled "Two Terminal Incandescent Lamp Controller" issued Jul. 9, 1991, there are disclosed and claimed new and useful improvements in the field of controlling various lighting functions of an incandescent lamp bulb, such as timing, duty cycle control, dimming and illumination intensity. This two terminal incandescent lamp controller is operative to provide in memory certain data values corresponding to the timing or sequence at which power interruptions to the memory may occur. Timed or sequenced power interruptions to the memory are created in order to select a particular data value for storage in memory which is then operative to control either the conduction time, the duty cycle, or the illumination intensity of the lamp bulb. This conduction time, duty cycle, or illumination intensity control is achieved by connecting an AC triggerable switch, such as a TRIAC, to the lamp and controlling its conductive state by the application thereto of the particular data value selected for storage in the memory of a microprocessor.

In a subsequent commonly assigned U.S. Pat. No. 5,126,634 entitled "Electronic Control Module (ECM) for Controlling Lighting Functions of a Lamp Bulb and Method of Manufacture" there are disclosed and claimed further new and useful improvements in the field of lamp bulb function control. These improvements include, among other things, a new and improved process for manufacturing a circuit integrated and controlled light bulb. This manufacturing process includes the steps of providing a light bulb having a filament wire therein and a dielectric insulator at one end of the bulb, with the insulator having a recessed cavity adjacent to which an opening extends to an interior section of the bulb. An electronic control module (ECM) is mounted in this receptacle and then connected to a filament wire of the bulb for thereby controlling one or a plurality of bulb lighting functions in response to the operation of the electronic control module.

In yet a subsequently filed and commonly assigned U.S. application Ser. No. 07/847,179 entitled "Lamp Bulb With Integrated Bulb Control Circuitry and Method of Manufacture" filed Mar. 9, 1992, now U.S. Pat. No. 5,214,354, there are disclosed and claimed yet still further new and useful improvements in the field of electronic control module design wherein a new and improved ECM article of manufacture is constructed having a metal housing with a base or floor member being surrounded by an upstanding wall member defining an opening in the housing. A ceramic substrate is mounted on the base member, and bulb lighting control circuitry is constructed on the substrate and has a conductive bridge member connected thereto for transmitting control signals from a microprocessor in the bulb lighting control circuitry to the filament of a light bulb. This application and the above two patents preceding it are incorporated herein by reference.

Whereas the above identified inventions represent most significant advances in the fields of lamp bulb manufacture and associated lighting function control, the operation of the TRIAC in the ECM module in response to microprocessor controlled input signals can, in some cases, generate undesirable radio frequency interference (RFI) radiation. This RFI is generated as a result of the steep di/dt rise time due to the TRIAC turn-on from voltage on each one-half cycle of the AC line voltage which is applied across the anode and cathode terminals of the TRIAC. This undesirable radio frequency interference can be radiated as RF signals from the lamp bulb acting as an antenna and into the surrounding ambient, and it can also be transmitted directly back through the AC line voltage source to thus provide electrical interference to other appliances connected to this same source of AC voltage. In either case, this radio frequency interference is undesirable and may in some cases exceed acceptable electrical code levels for RFI in certain countries.

SUMMARY OF INVENTION

The general purpose and principal object of the present invention is to provide a significant reduction in the above RFI levels for ECM controlled lamp bulbs and one which is highly compatible with both the lamp bulb manufacturing process and also with the novel construction of the ECM module disclosed and claimed in my above identified copending application Ser. No. 07/847,179 now U.S. Pat. No. 5,214,354.

Another object of this invention is to provide a new and improved lamp bulb manufacturing process which utilizes existing space and construction within the screw shell base of a lamp bulb in order to integrate an ECM module and module control circuitry therein, while simultaneously adding only a minimal additional cost to the overall lamp bulb manufacturing process.

Another object of this invention is to provide a new and improved lamp bulb as a stand alone article of manufacture which is capable of operating with one or a plurality of lighting control functions.

Another object of this invention is to provide a new and improved TRIAC control circuit for use with an ECM module mounted in the screw shell base of a lamp bulb.

The above purpose and objects are accomplished by, among other things in a preferred form, providing a magnetic spool having an opening or passageway therethrough, with the spool being precisely sized to fit into the screw shell base of a lamp bulb. This spool has one unprotected metal end sized to fit into the interior of the screw shell base and the other metal end surrounded by a cylindrical insulating sleeve or ring which is sized to receive an insulating cap with an opening through its outer surface. The insulating sleeve and cap are together sized to engage and hold an ECM module in a fixed position on the other metal end of the spool. A winding carried on the spool is connected at one end to the ECM, and when the spool in inserted into the screw shell base, the other end of the winding is connected to a filament wire of the lamp bulb. In this manner, the combination magnetic spool and winding provides a large inductor, L, which is connected in series between the lamp bulb filament and the ECM and thus across the AC line. This large inductor is one example of a current limiting element which substantially reduces the di/dt rise time of current in this series circuit on each conductive one-half cycle of a TRIAC within the ECM. This operation in turn substantially reduces radio frequency interference both radiated from the lamp bulb acting as an antenna and directly conducted back into the AC line.

The construction of an inductor assembly can be accomplished by a variety of methods. In the simplest form, a coil of fine wire would have inductive properties which might suffice to give the amount of inductance required for satisfactory RFI filtering action. However, as a practical matter, obtaining the required 1 to 10 millihenrys necessary for RFI control dictates increasing the inductance per unit volume. Thus by utilizing a magnetic concentrating material such as soft iron or steel or a ferrite, the inductance per given number of turns can be increased by orders of magnitude.

In a preferred process embodiment of the invention, the lamp bulb assembly includes the steps of: providing an incandescent lamp bulb having a screw shell base into which an elongated lamp exhaust tube and a pair of filament wires extend from within the bulb; inserting a magnetic spool with an inductive winding thereon into the screw shell base; attaching an electronic control module to one end of the spool; connecting one end of the inductive winding to one of the filament wires within the bulb; and connecting the other end of the inductive winding to an output terminal of the electronic control module.

In accordance with a preferred lamp bulb embodiment of the invention there is provided a unitary incandescent lamp bulb operative with controlled lighting functions such as timing, illumination, intensity, and duty cycle control. The lamp bulb contains a filament, a lamp exhaust tube, and a pair of filament wires extending into a screw shell base which is secured to an end section of the glass bulb. The lamp bulb is characterized in that a magnetic spool is mounted within the screw shell base and has an opening therein surrounding the lamp exhaust tube. A winding on the outer surface of the spool is connected at one end to one of the pair of wires from the lamp bulb filament and at the other end to an output terminal of the electronic control module.

In accordance with a preferred electronic circuit embodiment of the invention, there is provided a lamp bulb filament, inductor, and electronic control module all connected in series across a pair of AC line voltage terminals, with a capacitor also and optionally connected in parallel across the inductor and the ECM control module. The capacitor forms a second order filter having improved RFI attenuation characteristics.

The above brief summary of the invention, together with its attendant objects, advantages, and novel features, will become more readily apparent in the following description of the accompanying drawings.

BRIEF DESCRIPTION OF THE DRAWINGS

FIG. 5 also shows the optional capacitive connection in parallel with the inductor and the ECM control module.

DETAILED DESCRIPTION OF THE PRESENTLY PREFERRED EMBODIMENTS

Figure 1:
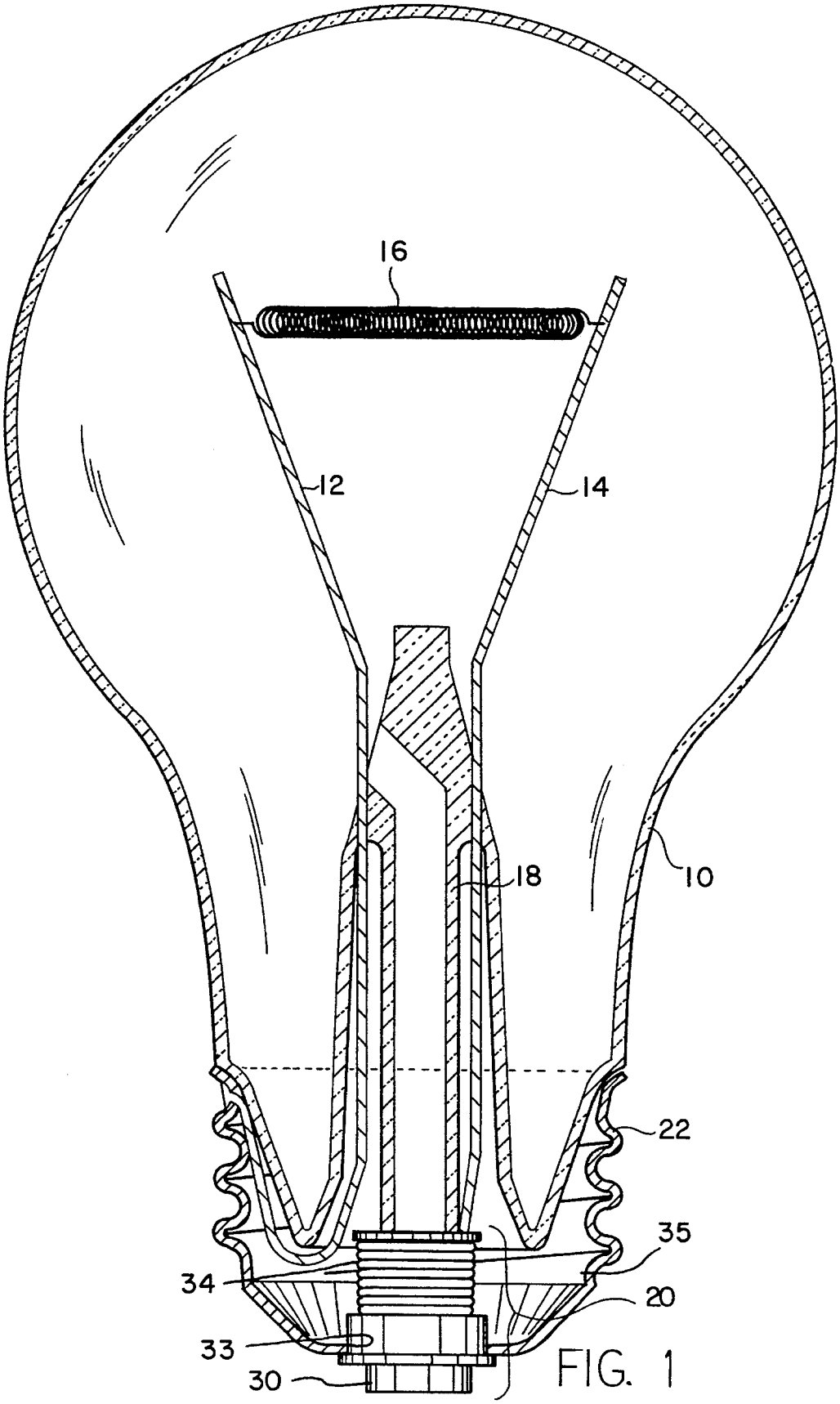
FIG. 1 is an assembled perspective view of an incandescent lamp bulb which has been constructed in accordance with the present invention.

Referring now to FIG. 1, the incandescent lamp bulb shown therein includes an outer glass or other light-passing translucent housing 10 surrounding a pair of filament wires 12 and 14 between which a filament 16 is connected in conventional fashion. An elongated lamp exhaust tube 18 is centrally located between the filament wires 12 and 14, and the complete magnetic spool and inductor assembly designated generally as 20 is mounted in the lower end of the lamp bulb 10 where it is surrounded as shown by the screw shell base 22. The screw shell base 22 is adapted for connecting the lamp bulb to a conventional electrical socket (not shown), as is well known.

Figure 2:
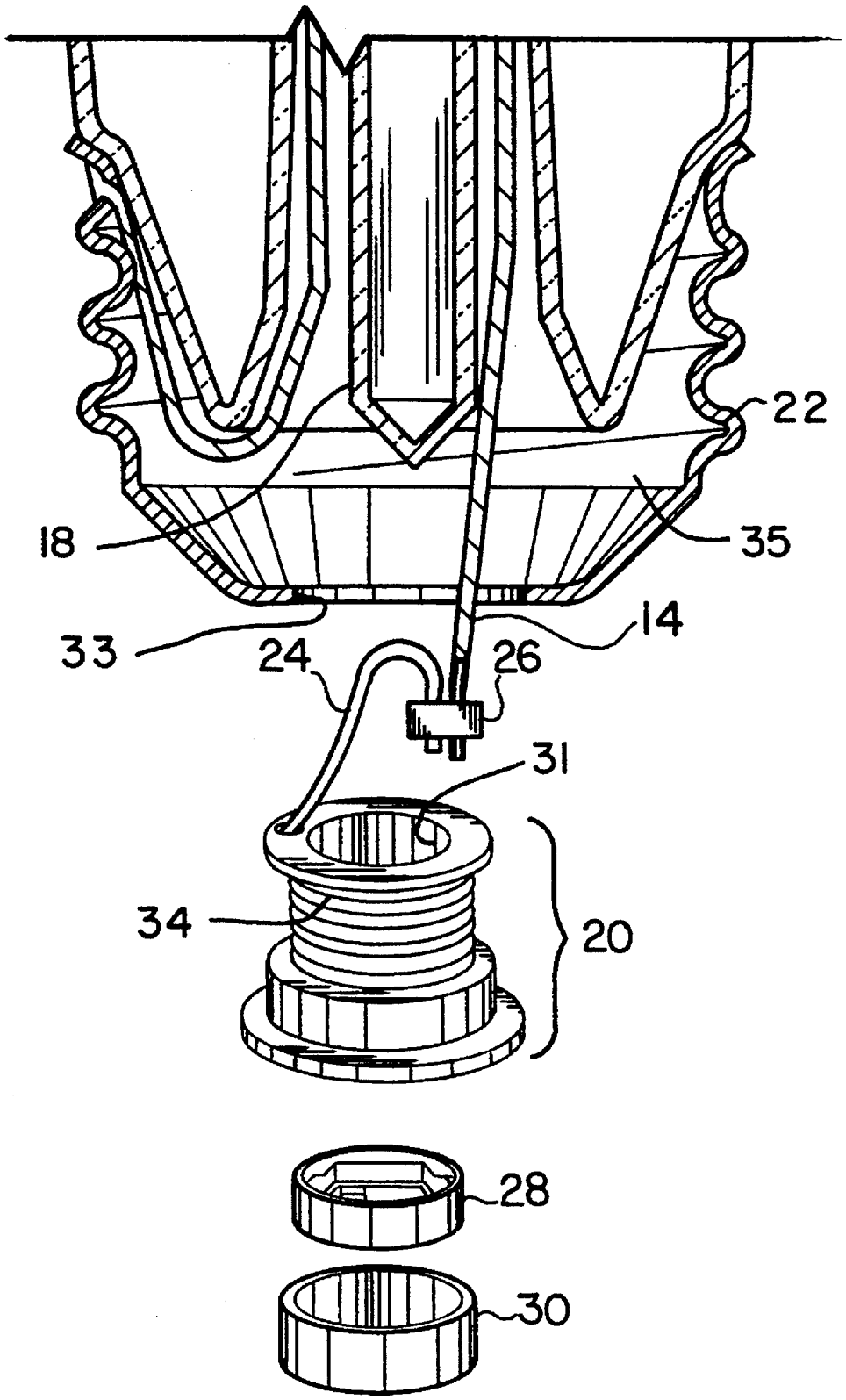
FIG. 2 is an exploded and fragmented perspective view showing how the RFI inductor assembly of the present invention is mounted and connected to the screw shell bulb base and filament wires of the lamp bulb in FIG. 1.

Referring now to FIG. 2, this fragmented and partially exploded perspective view shows the connection of the magnetic spool and inductor assembly 20, with the one end 24 of the inductor coil being connected through a connector 26 to one end of the filament wire 14. The ECM control module 28 is concentrically positioned in a recess along the central longitudinal axis of the inductor and spool assembly 20, and a retaining member 30 is used to hold the ECM module 28 in position within the interior of the magnetic spool and inductor assembly 20. The ECM module 28 is preferably of the type disclosed in the above identified U.S. Pat. No. 5,126,634 issued to Samuel A. Johnson and assigned to the present assignee.

An opening 31 of the assembly receives and surrounds the lower end of the exhaust tube 18, as is shown in FIG. 1. A lower portion of the assembly 20 extends through an opening 33 formed in the screw shell base 22, as is also shown in FIG. 1. A winding 34 (FIGS. 3 and 4) of the assembly 20, and a substantial portion of the assembly 20 are positioned within a hollow interior 35 of the screw shell base 22 of the assembled lamp bulb, as is also shown in FIG. 1.

Figure 3:
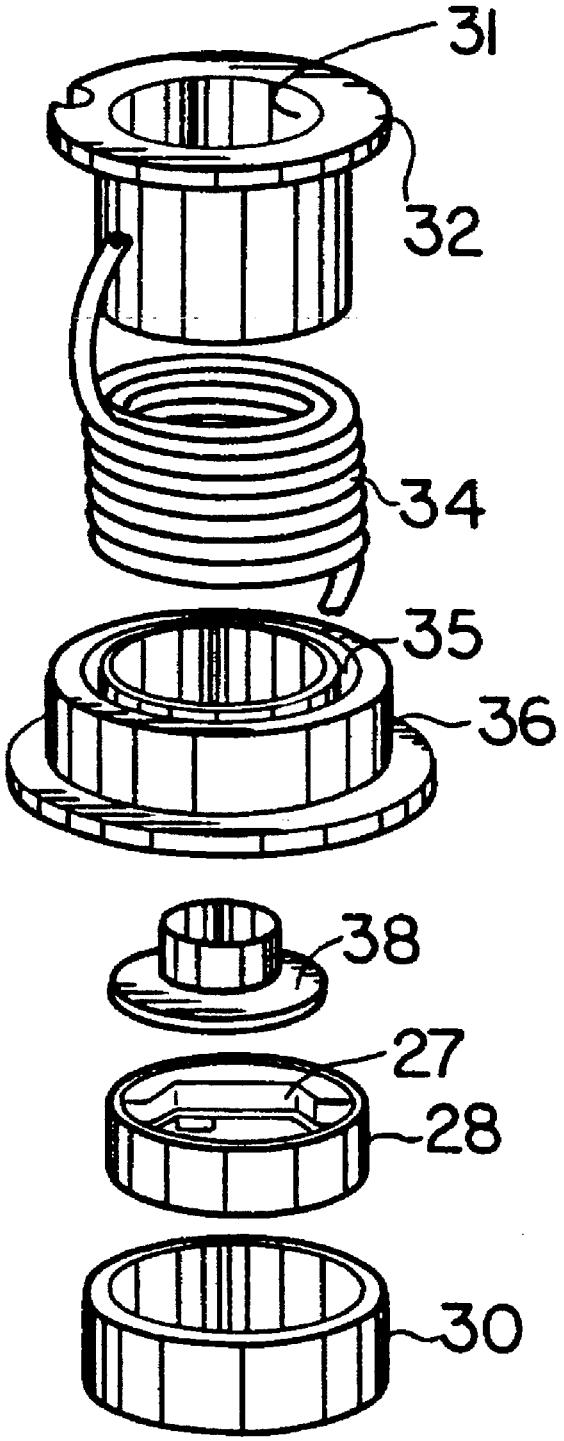
FIG. 3 is an exploded perspective view showing only the six major components of the inductor assembly according to a preferred embodiment of the invention.

Referring now to FIG. 3, this perspective view further explodes all of the six major components within the inductor and spool assembly 20 shown in FIG. 2 and includes an upper bobbin member 32 around which the inductive coil of wire 34 is wound. The inductive coil 34 is held in place by the cylindrical groove 35 within the lower bobbin member 36. A small conductive eyelet 38 is adapted for positioning between a conductive bridge 27 of the ECM module 28, and it serves to connect the conductive bridge 27 of the ECM module 28 to the lower end of the inductive coil of wire 34. As previously indicated, a retaining ring 30 is adapted to be press fit between the outer cylindrical housing of the ECM module 28 and the interior walls of the lower bobbin member 36.

Figure 4:
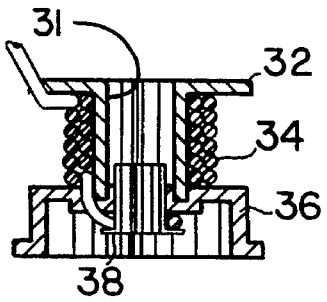
FIG. 4 is a fragmented perspective view showing how the coil of wire is wound on the magnetic spool and connected to the ECM control module.

Referring now to FIG. 4, this cut-away cross section view more clearly shows the exact geometry of the upper and lower bobbin members 32 and 36 and how the inductive coil 34 connects around the exterior walls of the upper bobbin member 32 and into the eyelet 38 to which the conductive bridge of the ECM module is connected.

Figure 5:
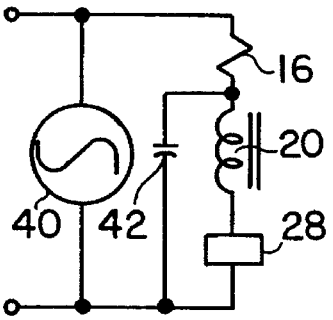
FIG. 5 is a schematic circuit diagram showing the serial connection of the bulb filament, bulb filament wire, inductor, and ECM control module.

FIG. 5 is a schematic circuit diagram showing the lamp bulb filament wire 16, the inductor assembly 20, and the ECM module 28 all connected in series across a source 40 of a AC line voltage. As previously indicated, a capacitor 42 may be optionally connected in parallel as shown with the inductor assembly 20 and the ECM module 28 in order to form a second order filter having improved RFI attenuation characteristics.

Figure 6:
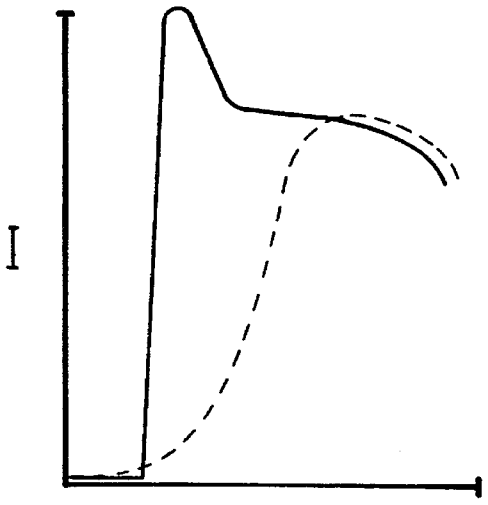
FIG. 6 shows a pair of curves of di/dt rise times when using the ECM both with and without the inductive and capacitive filter. The dotted line curve indicates filtering and the steep solid line curve is generated when no filter is used.

FIG. 6 shows two plots of current versus time when connecting the ECM module 281 to the lamp bulb filament 16. The solid line graph represents the circuit connection without using the inductor assembly 20, and the dotted line graph representing how the di/dt rise time is significantly reduced by using the above circuitry in FIG. 5 and construction 20 in accordance with the present invention.

Various modifications may be made in and to the above described embodiment without departing from the scope of this invention. For example, various types of magnetic materials may be utilized in the formation of the spool assembly described, and the various constructional changes may be made in the particular way that the inductive coil is mounted concentrically around the lamp exhaust tube and connected to the filament wires therein. Accordingly, these and other constructional and circuit modifications may be made by those skilled in the art without departing from the spirit and scope of the following appended claims.

I claim:

1. An incandescent lamp bulb operative to provide controlled lighting functions such as variable illumination intensity, variable timing, and variable duty cycle, and including a glass bulb containing a filament and further including a lamp exhaust tube and a pair of wires extending into a screw shell base which is secured to one end section of the glass bulb, characterized in that: a magnetic spool is mounted within said screw shell base and has an opening therein surrounding said lamp exhaust tube, and a winding on said magnetic spool is connected at one end to one of said pair of wires and at the other end to an electronic control module mounted on said magnetic spool.

2. An incandescent lamp as defined in claim 1 wherein said electronic control module contains a TRIAC connected in series with said winding.

3. A process for assembling an incandescent lamp bulb operative with variable lighting control functions to restrict radiated radio frequency interference (RFI) inherently emitted during the variable lighting control function, including the steps off:

a. providing an incandescent lamp bulb having a screw shell base into which an elongated lamp exhaust tube and a pair of filament wires extend from within said incandescent lamp bulb, b. inserting a magnetic spool with an inductive winding thereon into said screw shell base, c. attaching an electronic control module to one end of said magnetic spool at a location where said electronic control module is adjacent to an opening in said screw shell base, d. connecting one end of said inductive winding to one of said filament wires, e. connecting the other end of said inductive winding to an output terminal of said electronic control module, and f. connecting the other of said filament wires to said screw shell base.

4. The process defined in claim 3 wherein said electronic control module is provided with a TRIAC.

5. An electronic circuit of a function controlled lamp bulb which includes a translucent housing having an exhaust tube extending therefrom, a base connected to the translucent housing at a location to surround the exhaust tube, and a bulb filament wire extending from the translucent housing within a space existing between the base and the translucent housing, said electronic circuit restricting radiated radio frequency interference (RFI) inherently emitted during operation of the function controlled lamp bulb, said electronic circuit comprising an inductive winding and an electronic control module located within the space between the base and the translucent housing, the inductive winding formed as a coil encircling the exhaust tube and connected at one end to the filament wire and connected at the other end to the electronic control module whereby the filament wire, inductive winding and electronic control module are connected in series, the series connected filament wire, inductive winding and electronic control module adapted to be connected across a pair of AC line voltage terminals widen the lamp is energized, said electronic circuit attached to the base and forming a part of the lamp bulb.

6. The electronic circuit defined in claim 5 wherein said inductive winding is mounted on a magnetic spool to substantially increase the inductance value in series with said filament wire and electronic control module compared to the inductance value of the winding itself.

7. The electronic circuit defined in claim 6 wherein said electronic control module contains a TRIAC.

8. The electronic circuit defined in claim 5 which further includes a capacitor connected in parallel with the series connected electronic control module and inductive winding.

9. An incandescent lamp bulb including a lamp exhaust tube, a lamp filament wire, an inductive coil connected at one end to the lamp filament wire and operative to reduce di/dt rise time of current conducted through the lamp filament wire when an AC voltage is applied to the lamp bulb, a magnetic spool surrounding said lamp exhaust tube and around which said inductive coil is wound, and an electronic control module connected at the other end of said inductive coil.

10. The incandescent lamp bulb defined in claim 9 which further includes a capacitor connected in parallel with said inductive coil and operative to form with said inductive coil a second order filter having radio frequency interference attenuation characteristics improved over those of said inductive coil itself.

11. The incandescent lamp bulb defined in claim 9 wherein said inductive coil is connected to an electronic control module within the hollow interior, the electronic control module containing a TRIAC.

12. The incandescent lamp bulb defined in claim 9 wherein said electronic control module includes a TRIAC.

13. The incandescent lamp bulb defined in claim 12 which further includes a capacitor connected in parallel with said inductive coil and operative to form with said inductive coil a second order filter having radio frequency interference attenuation characteristics improved over those of said inductive coil itself.

14. An incandescent lamp having a translucent housing and a single filament within the translucent housing for emitting light at maximum intensity when energized by a predetermined level of electrical current passing through the filament, and an improvement in combination therewith comprising:

an inductor assembly having an inductance in the range of one to ten millihenrys located within the lamp and electrically connected to the filament and operative to limit the rate of change in current per change in time (di/dt) passing through the single filament to a predetermined di/dt value in response to an instantaneous change in voltage applied across the single filament, the predetermined di/dt value selected to restrict radiated radio frequency interference (RFI) inherently emitted from the di/dt conducted through the single filament and lamp to a value acceptable under an electrical code governing RFI radiation from an incandescent lamp.

15. An incandescent lamp as defined in claim 14, wherein:

the inductor assembly includes a spool of magnetic concentrating material and a coil of wire wound around the spool.

16. An incandescent lamp having a translucent housing, a filament within the housing for emitting light when energized by electrical current passing through the filament, and an exhaust tube extending into the housing, and an improvement in combination therewith comprising:

a current change limiting element comprising an inductor assembly located within the lamp and electrically connected to the filament and operative to limit the rate of change in current per change in time (di/dt) passing through the filament to a predetermined di/dt value in response to an instantaneous change in voltage applied across the filament, the predetermined di/dt value selected to restrict radiated radio frequency interference (RFI) inherently emitted from the di/dt conducted through the filament and lamp, and wherein:

the inductor assembly includes a spool of magnetic concentrating material having an opening and a coil of wire wound around the spool to surround the opening;

the coil of wire is connected in series with the filament; and the exhaust tube extends through the opening in the spool.

17. An incandescent lamp having a translucent housing, a filament within the housing for emitting light when energized by electrical current passing through the filament, a shell base which has a generally hollow interior and which is attached to the housing by which to connect the lamp in a socket, a pair of filament wires each having a first end connected within the housing to a respectively opposite end of the filament, a second end of one filament wire connected to the shell base, and an improvement in combination therewith comprising:

an inductor assembly having a spool of magnetic concentrating material and a coil of wire wound around the spool, the inductor assembly located within the hollow interior of the shell base, the coil of wire connected at a second end of the other one of the filament wires, the inductor assembly limiting the rate of change in current per change in time (di/dt) passing through the filament to a predetermined di/dt value in response to an instantaneous change in voltage applied across the filament, the predetermined di/dt value selected to restrict radiated radio frequency interference (RFI) inherently emitted from the di/dt conducted through the filament and lamp, and a capacitor located within the hollow interior of the shell base and connected between the shell base and the connection of the second end of the other filament wire and the one end of the coil of wire.

18. An incandescent lamp as defined in claim 17, wherein:

the filament, the capacitor and the inductor assembly form a second order filter; and the resistance value of the filament, the capacitance value of the capacitor and the inductance value of the inductor assembly restricts the RFI to a value acceptable under an electrical code governing RFI radiation from the lamp.

19. An incandescent lamp as defined in claim 17, in which the shell base includes a recess adapted to receive therein an electronic control module (ECM) operative to control the conduction of current through the filament, and further comprising:

an ECM positioned within the recess and electrically connected to the other end of the coil of wire.

20. An incandescent lamp as defined in claim 19, wherein:

the ECM is electrically connected to the other end of the coil of wire in the recess; and electrical power for the lamp is conducted between the socket and the ECM and between the socket and the shell base.

21. An incandescent lamp as defined in claim 20, wherein:

the shell base includes an opening therethrough;

the spool extends through the opening in the shell base;

the recess is formed in the spool; and the recess and the ECM in the recess are accessible from an exterior of the lamp and the shell base.

22. An incandescent lamp having a translucent housing, a filament within the housing for emitting light when energized by electrical current passing through the filament, a filament wire extending from the housing, and a base connected to the housing and extending away from the housing at the location of the filament wire to provide a space between the base and the housing, and an improvement in combination therewith comprising a physical and electronic circuit assembly connected to the base and located within the space between the base and the housing, said physical and electronic circuit assembly comprising:

a current change limiting element accommodated within the circuit assembly and located within the space and electrically connected to the filament wire within the space and operative to limit the rate of change in current per change in time (di/dt) passing through the filament to a predetermined di/dt value in response to an instantaneous change in voltage applied across the filament, the predetermined di/dt value selected to restrict radiated radio frequency interference (RFI) inherently emitted from the di/dt conducted through the filament of the lamp to a value which restricts the RFI to a value acceptable under an electrical code which governs RFI radiation from the lamp; and an electronic control module (ECM) accommodated within the circuit assembly and connected to the current change limiting element and operative to control the conduction of current through the filament.

23. An incandescent lamp as defined in claim 22, further comprising:

an electronic control module (ECM) located within the lamp and operative to control the conduction of current through the filament, the ECM electrically connected to the current change limiting element;

a filter element located within the lamp and electrically connected to the current change limiting element and to the filament and to the ECM, the filter element operative in conjunction with the current change limiting element and the filament to restrict the di/dt through the filament created by the ECM to a value which restricts the RFI to a value acceptable under an electrical code governing RFI radiation from the lamp.

24. An incandescent lamp as defined in claim 23, wherein:

the filter element comprises a capacitor;

the current change limiting element comprises an inductor; and the filament, the capacitor and the inductor form a second order filter.

25. An incandescent Lamp as defined in claim 23, wherein:

the current change limiting element, the filter element and the ECM are located substantially within the hollow interior of the base.

26. An incandescent lamp having a translucent housing, a filament within the housing for emitting light when energized by electrical current passing through the filament, a filament wire extending from the housing, and a base connected to the housing and extending away from the housing at the location of the filament wire to provide a space between the base and the housing, and an improvement in combination therewith comprising a physical and electronic circuit assembly connected to the base and located within the space between the base and the housing, said physical and electronic circuit assembly comprising:

an electronic control module (ECM) accommodated within the electronic circuit assembly located within the space and electrically connected to the filament wire and operative to control the conduction of current through the filament to achieve selected degrees of illumination from the filament; and a filter element accommodated within the electronic circuit assembly and located within the space and electrically connected to the filament wire and the ECM within the space, the filter element operative to limit the rate of change in current per change in time (di/dt) conducted through the filament to a predetermined di/dt value in response to an instantaneous change in voltage applied by the ECM across the filament, the predetermined di/dt value selected to restrict radiated radio frequency interference (RFI) inherently radiated from the di/dt to a value acceptable under an electrical code governing RFI radiation from the lamp.

27. An incandescent lamp as defined in claim 26, wherein:

the filter element comprises a second order filter.

28. In an incandescent lamp as defined in claim 26, in which the lamp also includes a shell base which has a generally hollow interior, the shell base is attached to the housing by which to connect the lamp in a socket, and wherein:

the filter element and the ECM are located substantially within the hollow interior of the shell base.

29. The process defined in claim 3 further including the step of:

connecting a capacitor in parallel with the electronic control module and inductive winding.

* * * * *